US009920264B2

(12) United States Patent
Ancheyta Juarez et al.

(10) Patent No.: US 9,920,264 B2
(45) Date of Patent: Mar. 20, 2018

(54) PROCESS OF HYDROCONVERSION-DISTILLATION OF HEAVY AND/OR EXTRA-HEAVY CRUDE OILS

(75) Inventors: Jorge Ancheyta Juarez, Mexico City (MX); Jose Antonio Domingo Muñoz Moya, Mexico City (MX); Luis Carlos Castañeda Lopez, Mexico City (MX); Sergio Ramirez Amador, Mexico City (MX); Gustavo Jesus Marroquin Sanchez, Mexico City (MX); Guillermo Centeno Nolasco, Mexico (MX); Fernando Alonso Martinez, Mexico City (MX); Rodolfo Antonio Aguilar Escalante, Mexico City (MX)

(73) Assignee: Instituto Mexicano del Petroleo, Mexico City (MX)

( * ) Notice: Subject to any disclaimer, the term of this patent is extended or adjusted under 35 U.S.C. 154(b) by 215 days.

(21) Appl. No.: 13/598,684

(22) Filed: Aug. 30, 2012

(65) Prior Publication Data

US 2013/0056394 A1 Mar. 7, 2013

(30) Foreign Application Priority Data

Aug. 31, 2011 (MX) ..... MX/a/2011/009116

(51) Int. Cl.
*C10G 67/16* (2006.01)
*C10G 67/00* (2006.01)
(Continued)

(52) U.S. Cl.
CPC ..... *C10G 67/00* (2013.01); *C10G 45/08* (2013.01); *C10G 47/12* (2013.01); *C10G 47/14* (2013.01);
(Continued)

(58) Field of Classification Search
CPC ..... C10G 69/00; C10G 69/02; C10G 69/14; C10G 65/00; C10G 65/02; C10G 65/12; C10G 65/14; C10G 69/12; C10G 45/08; C10G 47/12; C10G 47/14; C10G 67/00; C10G 2300/201; C10G 2300/308;
(Continued)

(56) References Cited

U.S. PATENT DOCUMENTS 3,684,700 A * 8/1972 Langlois et al. ..... 208/251 H
4,039,429 A 8/1977 van Klinken et al.
(Continued)

OTHER PUBLICATIONS

Refining Process Handbook, Chapter 1 Refinery Distillation, pp. 1-28, 2006.*
(Continued)

*Primary Examiner* — Prem C Singh
*Assistant Examiner* — Brandi M Doyle
(74) *Attorney, Agent, or Firm* — Dickinson Wright, PLLC

(57) ABSTRACT

A process for hydroconversion-distillation of heavy and/or extra-heavy crude oils, which comprises four stages:
1) desalting and separation of the feedstock;
2) catalytic hydrotreating of light fraction (optional);
3) catalytic hydroconversion of heavy fraction, and
4) distillation of hydrotreated products
to provide products that can be processed in conventional refining schemes designed to operate with light and intermediate crude oils.

20 Claims, 1 Drawing Sheet

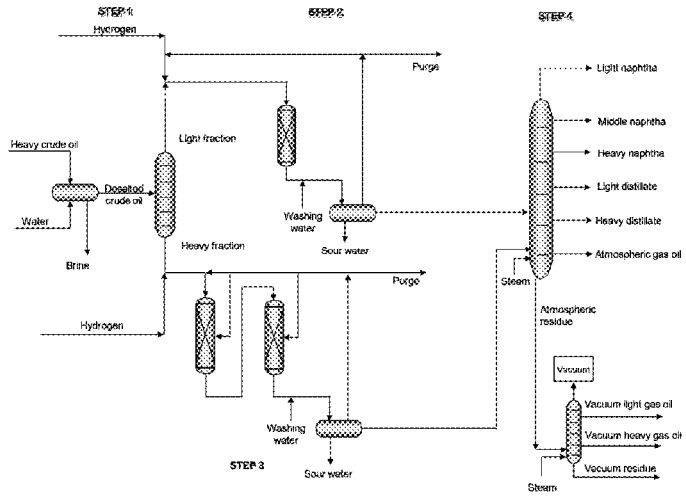

(51) Int. Cl.

| | |
|---|---|
| ***C10G 45/08*** | (2006.01) |
| ***C10G 47/12*** | (2006.01) |
| ***C10G 47/14*** | (2006.01) |
| ***C10G 65/12*** | (2006.01) |
| ***C10G 65/14*** | (2006.01) |

(52) U.S. Cl.
CPC ..... *C10G 65/12* (2013.01); *C10G 65/14* (2013.01); *C10G 2300/201* (2013.01); *C10G 2300/308* (2013.01)

(58) Field of Classification Search
CPC ..... C10G 33/00; C10G 33/02; C10G 33/04; C10G 33/06; C10G 33/08; C10G 31/08; B01D 17/02; B01D 17/04; B01D 17/045
USPC ..... 208/80, 89
See application file for complete search history.

(56) References Cited

U.S. PATENT DOCUMENTS

| | | | | |
|---|---|---|---|---|
| 4,396,493 | A | 8/1983 | Eilers et al. | |
| 4,415,436 | A * | 11/1983 | Angevine | 208/89 |
| 4,534,847 | A | 8/1985 | Roberts et al. | |
| 4,591,426 | A | 5/1986 | Krasuk et al. | |
| 4,655,905 | A | 4/1987 | Plumail et al. | |
| 4,756,821 | A | 7/1988 | Giuliani et al. | |
| 4,885,080 | A * | 12/1989 | Brown et al. | 208/218 |
| 5,417,846 | A | 5/1995 | Renard | |
| 6,277,270 | B1 | 8/2001 | Morel et al. | |
| 6,303,089 | B1 | 10/2001 | Wallace et al. | |
| 6,306,287 | B1 | 10/2001 | Billon et al. | |
| 6,342,152 | B1 * | 1/2002 | Yoshita | 208/108 |
| 6,447,671 | B1 | 9/2002 | Morel et al. | |
| 7,651,604 | B2 | 1/2010 | Ancheyta-Juarez et al. | |
| 2002/0008049 | A1 * | 1/2002 | Inomata et al. | 208/57 |
| 2002/0130063 | A1 | 9/2002 | Vuillemot et al. | |
| 2003/0000867 | A1 * | 1/2003 | Reynolds | 208/89 |
| 2003/0111387 | A1 | 6/2003 | Mukherjee et al. | |
| 2005/0101480 | A1 * | 5/2005 | Ackerman et al. | 502/313 |
| 2007/0187294 | A1 * | 8/2007 | Ancheyta Juarez et al. | 208/58 |
| 2009/0261016 | A1 | 10/2009 | Marchionna et al. | |
| 2010/0122934 | A1 * | 5/2010 | Haizmann et al. | 208/86 |
| 2010/0176032 | A1 * | 7/2010 | Droughton | 208/245 |
| 2010/0230323 | A1 * | 9/2010 | Ancheyta Juarez | C10G 65/04 208/59 |
| 2011/0155639 | A1 * | 6/2011 | Colyar | C10G 49/12 208/95 |

OTHER PUBLICATIONS

Surinder Parkash, Refining Processes Handbook, Chapter 1 Distillation, Gulf Professional Publishing, Oct 2003, pp. 1-28.*

* cited by examiner

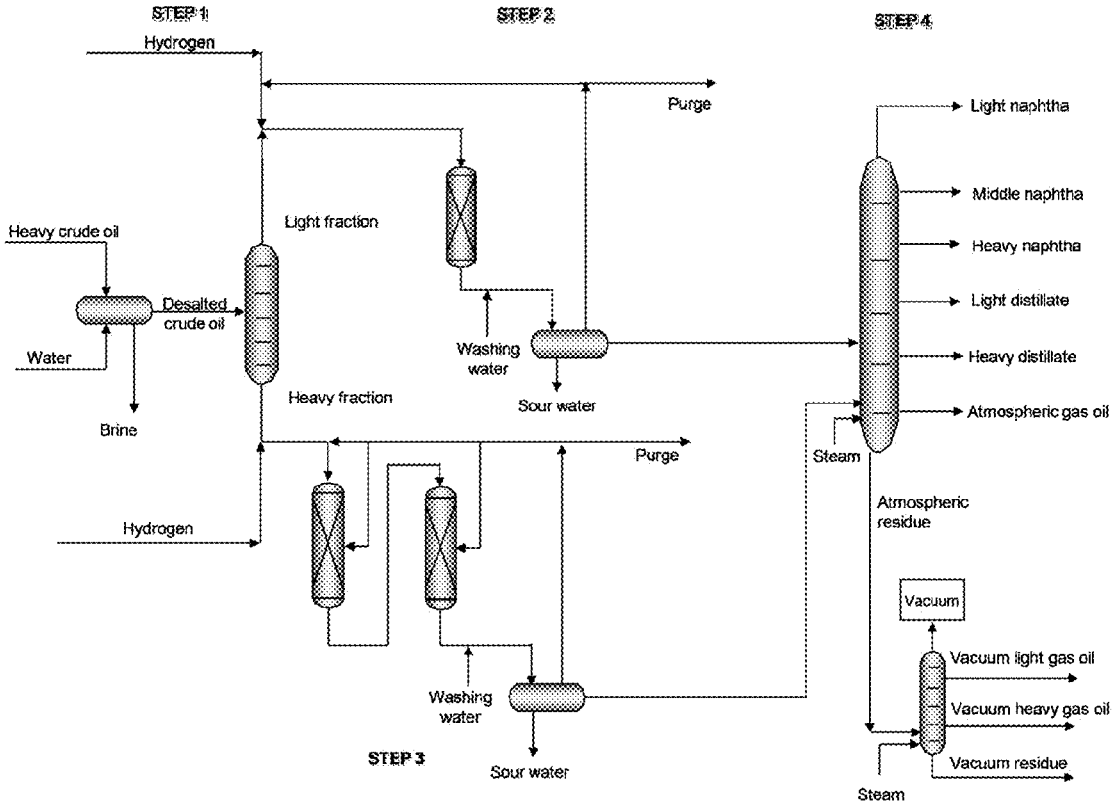
STEP 1
STEP 2
STEP 4
Hydrogen
Purge
Light naphtha
Middle naphtha
Heavy naphtha
Light distillate
Heavy distillate
Atmospheric gas oil
Heavy crude oil
Light fraction
Desalted crude oil
Water
Brine
Washing water
Sour water
Heavy fraction
Purge
Steam
Hydrogen
Atmospheric residue
Vacuum
Vacuum light gas oil
Vacuum heavy gas oil
Vacuum residue
Washing water
STEP 3
Sour water
Steam

PROCESS OF HYDROCONVERSION-DISTILLATION OF HEAVY AND/OR EXTRA-HEAVY CRUDE OILS

CROSS-REFERENCE TO RELATED APPLICATION

This application claims the benefit under 35 U.S.C. § 119 of Mexican Patent Application No. MX/a/2011/009116, filed Aug. 31, 2011, which is hereby incorporated by reference in its entirety.

TECHNICAL FIELD OF THE INVENTION

The present invention relates to a process of the refining industry of petroleum: hydroconversion-distillation of heavy and/or extra-heavy crude oils, more specifically to the catalytic hydroconversion of heavy and/or extra-heavy crude oils, and distillation of hydrotreated products.

In this regard, it is important to point out that, by means of the process of the present invention products that can be processed in conventional refining schemes, designed to operate with light and intermediate crude oils are obtained.

BACKGROUND OF THE INVENTION

The depletion of light and medium crude oil reserves has forced the extraction and refining of increasingly heavier crude oils, among other economic and technological type of implications, this problem has constrained the functionality of existing refineries in the world, as they were designed and built exclusively for processing light and medium crude oils and their mixtures.

Hence, many refineries have had to limit their operations and compete for the purchase of light and medium crude oils whose prices have been increasingly high.

Other refineries have invested in the installation of alternative processes that allow them for refining heavy and extra-heavy crude oils, some of these technologies are likely to be installed upstream to the processing of the heavy oil fraction (vacuum residue) such as: delayed coking, catalytic cracking of residue, solvent deasphalting, however, these technologies do not solve the initial problem of refining heavy crude.

The state-of-the-art closest to the present invention, by referring to the use of processes which combine multiple steps and/or refining steps (combined processes) to improve the properties of the heavy and extra-heavy crude oils, is here represented by the following patent documents:

U.S. Pat. No. 4,591,426, dated May 27, 1986, protects a process that combines several technologies to improve the properties of heavy crude oils, characterized by mild reaction conditions and high liquid-hourly space velocity. It involves mainly the following stages: (1) The hydrocracking of heavy oil atmospheric residue in a bubble upflow reactor, (2) The hydrotreating of distillates with final boiling temperature of 340° C. in a separate unit, (3) The deasphalting of heavy residue (510° C.+), and (4) The hydrotreating of deasphalted oil mixed with atmospheric residue. In this process a heavy crude oil with the following properties: 12° API, 2.9 weight % sulfur, 8.7 weight % asphaltenes, 11.1 weight % Conradson carbon, 56 vol. % residue (565° C.+) and 320 ppmw of vanadium, yields a synthetic crude of 27° API, 0.1 weight % sulfur, undetectable vanadium and 6 vol. % residue (565° C.+). The process yields 96 vol. % of heavy crude oil with 10 vol. % naphtha (final boiling temperature up to 190° C.). Hydrogen consumption is approximately 1.95 weight % of heavy crude oil and 40% of this weight is used in hydrocracking.

U.S. Pat. No. 6,303,089, dated Oct. 16, 2001, claims a combined hydrotreating process in which a gas stream rich in hydrogen can be recovered. In this process the gas stream is separated into two, a light hydrocarbon stream including hydrogen sulfide that is sent to the treatment of sour gases. The light fraction rich in hydrogen gas is recycled to the process to take advantage of it in the hydrotreating reactor. Moreover it involves the integration of solvent deasphalting, gasification and hydrotreating processes. The heavy fraction of crude oil is separated by solvent deasphalting in a section. This fraction may be gasified to generate hydrogen, energy, steam and synthesis gas.

U.S. 2002/0130063, published Sep. 19, 2002, claims a process for hydrotreatment of petroleum fractions which operates in at least two stages, a hydrodesulfurization and a hydrodearomatization, where it is possible to use separation zones in each one of them to recover the light fractions obtained. The feed to the reactors may be lateral to acquire countercurrent flow and maintain high values of the catalytic conversion and low pressure drop across the bed.

U.S. Pat. No. 6,447,671, dated Sep. 10, 2002, calls for a process of conversion of petroleum fractions in two steps: hydroconversion and hydrotreatment. The process is applied on feeds of hydrocarbons with at least 0.1 weight % of sulfur and an initial boiling point of at least 340° C. The first stage involves the treatment of hydrocarbon feed in a three-phase reactor with ebullated catalyst bed, the second stage involves the separation of catalyst particles entrained with the hydrocarbon, and finally, the third stage includes separation and processing of the light fraction and optionally a fixed-bed hydrotreating of the converted liquid fraction.

U.S. Pat. No. 4,756,821, dated Jul. 12, 1988, protects a hydrotreating process or hydro viscoreduction, wherein the heavy hydrocarbon feed is contacted with finely dispersed catalyst in the liquid phase. In order to separate the product from the catalyst, the effluent is passed through an inorganic membrane wall. The non-filtered oil containing a high concentration of catalyst is recycled to the reactor of hydroconversion. The filtered oil is the product of this process.

U.S. Pat. No. 4,655,905, dated Apr. 7, 1987, refers to a catalytic process in fixed-bed or moving-bed of a catalyst supported on alumina with at least one metal or compound of VB, VIB and VIII groups of the periodic table. This process considers the addition of at least one compound of a metal such as Mo, W, Ni, Co or Cr, particularly it is recommended the use of compounds such as halides, oxyhalides, oxides, polyacids such as poly isopolyacids and heteropolyacids and their salts; moreover halogenated compounds containing chlorine, bromine or iodine, the use of molybdenum compounds alone or in combination with nickel or cobalt is especially advantageous and molybdenum, phosphomolybdic acid and their salts are compounds which produce the best results.

U.S. Pat. No. 6,277,270, dated Aug. 21, 2001, protects a conversion process of hydrocarbons obtained from atmospheric distillation of crude oil comprising the following steps: a) vacuum distillation, b) hydrotreating the vacuum residue in at least a fixed-bed reactor at conditions that allow for reducing the sulfur content, c) hydroconversion of this residue in a three-phase ebullated-bed reactor. Finally, a catalytic cracking stage can be added for obtaining valuable distillate fractions. The process includes several steps of distillation of the heavy and light fractions to obtain valuable distillates.

U.S. Pat. No. 4,534,847, dated Aug. 13, 1985, protects a process characterized by heating a mixture of a hydrocarbon in the presence of a recycled solvent. The product of this process is separated into gas, liquid and solids through a vacuum distillation. The gas products having a boiling point lower than 454° C. undergo a distillation step to recover the used solvent. The ash-free liquid product is subjected to hydrotreating to obtain a product with low sulfur and nitrogen contents.

U.S. 2003/0111387, published Jun. 19, 2003, processes a middle distillate in the same vacuum gas oil hydrotreating plant or in the hydrocracking reactor at moderate conditions. Saving costs are allowed when a hydrotreater separated from middle distillate is not required. The main benefit of this process is that cracked feed such as light cycle oil, coker light gas oil, visbreaking gasoil or straight-run gasoil can be simultaneously hydrotreated by using the same existing equipment in the hydrocracking plant.

U.S. Pat. No. 6,306,287, dated Oct. 23, 2001, discloses a hydrotreating process in at least two steps involving a hydrodemetallization stage and second stage of hydrodesulfurization. Hydrodemetallization stage comprises two or more metal removal zones arranged in a series of reactors. In this process, an additional amount of a middle distillate is also fed and may also include hydroviscoreduction and solvent deasphalting stages.

U.S. Pat. No. 5,417,846, dated May 23, 1995, protects a very similar process to that of U.S. Pat. No. 6,306,287 B1, where the difference is that the hydrodemetallization zone comprises two or more zones, each one loaded with hydrodemetallization fixed-bed catalyst, where these hydrodemetallization zones operate alternately.

U.S. Pat. No. 4,396,493, dated Aug. 2, 1983, claims a process for the production of hydrocarbons with low content of Ramsbottom carbon residue. The mixture feed is a vacuum residue obtained by distillation of a crude oil and an asphaltenic bitumen obtained by distillation of a hydrotreated residual oil fraction. This mixture is hydrotreated in order to reduce the content of Ramsbottom Carbon. The obtained product is separated by atmospheric distillation. The atmospheric residue obtained is subjected to a solvent deasphalting process.

U.S. Pat. No. 4,039,429, dated Aug. 2, 1977, claims a process for hydrocarbon conversion involving the following steps: a) fractionation of crude oil by vacuum distillation, b) deasphalting the vacuum residue to obtain a deasphalted product and an asphalt, c) catalytic cracking of vacuum residue and the deasphalted oil, d) atmospheric fractionation of the cracked product to obtain a light fraction, a middle distillate and a residue, e) hydrotreating the intermediate fraction to low pressure conditions, a fraction of this distillate is recycled to the catalytic cracking zone; f) thermal cracking of the asphalt and the residue, g) fractionating the product of thermal cracking at least in a light distillate, an intermediate fraction and thermal residue h) hydrotreating the intermediate fraction of thermal cracking and recirculation of a portion of this product to the cracking zone; i) thermal gasification of the residue and catalytic reaction of product of gasification to produce hydrogen; j) feeding the obtained hydrogen to a hydrotreating zone at high pressure with at least a part of fractions from atmospheric and vacuum distillation k) feeding hydrogen produced to zones of low pressure hydrotreatment of vacuum residue and asphalt; l) feeding hydrogen to low pressure zones for the hydrotreatment of different streams.

U.S. 2009/0261016, published Oct. 22, 2009, protects a process for the conversion of heavy feedstocks involving the following steps: mixing the hydrocarbon with a hydrogenation catalyst and further sending the mixture to a hydrotreatment zone in which hydrogen is added alone or as a mixture of hydrogen with hydrogen sulfide; the product of this zone containing the slurry catalyst is sent to a first distillation zone which has several flash separation steps, atmospheric and vacuum distillation, the heavy fraction, rich in metal sulfides produced by the hydrodemetallization of the feed, is sent to a solvent deasphalting zone to obtain two products: a deasphalted oil which is sent to hydrotreatment, and the heavy fraction that is cleaned of dispersed catalyst to be sent to the first hydrotreating zone, which processes the heavier fractions.

U.S. Pat. No. 7,651,604, dated Jan. 26, 2010, protects a two stages process for catalytic hydrotreating at conditions of low pressure and in fixed-bed or ebullated-bed reactors. Hydrotreating is accomplished in two stages, the first of hydrodemetallization and the second of hydrotreatment. With this process, it is viable to obtain better quality crudes and higher content of most valuable distillates.

Previous technologies known by the applicant, were overcome by the present invention, since these technologies relate to conversion of crude processes for obtaining hydrocarbon cuts that can be refined upstream by means of known processes such as catalytic cracking, hydroconversion, deasphalting or coking, however, none of the cited references note and even suggest a hydroconversion-distillation process of heavy and/or extra-heavy crude oils.

It is therefore an object of the present invention to provide a process which comprises the catalytic hydroconversion of heavy and/or extra-heavy crude oils, and the distillation of the hydrotreated products.

An additional object of the present invention is to provide a process to obtain products that can be processed in conventional refining schemes, designed to operate with light and intermediate crudes.

SUMMARY OF THE INVENTION

A process has been discovered for the hydroconversion-distillation of heavy and extra heavy crude oils, which comprises desalting and separation of a feedstock comprising heavy and/or extra heavy crude oil to obtain a light fraction and a heavy fraction; subjecting the light fraction to catalytic hydrotreatment to obtain a hydrotreated fraction; subjecting the heavy fraction to catalytic hydroconversion; and distillation of the hydrotreated fraction to obtain distilled fractions that can be processed in conventional refining schemes, which are designed to process light and medium crude oils.

According to one embodiment of the invention, the feedstock to the desalting and separation of the feedstock is crude oil having 3 to 30 API gravity units, preferably 3-22

API gravity units, and most preferably 3-10 API gravity units, and the desalting and separation of the feedstock, operates at atmospheric pressure and temperatures from 280 to 420° C.

According to another embodiment of the invention, catalytic hydrotreating of the light fraction, is optional and may be omitted when the crude oil is so heavy that only a small volume of a light fraction is obtained, which fraction may be passed directly to distillation.

Catalytic hydrotreating of the light fraction may be carried out in a conventional reactor with catalysts of nickel-molybdenum (Ni—Mo) or cobalt-molybdenum (Co—Mo), in extruded or spherical shape, under a pressure of 10 to 80 $kg/cm^2$, hydrogen to hydrocarbon ratio of 350 to 3,000 $ft^3/bbl$, temperature of 280 to 380° C. and the volumetric feed flow related to catalyst volume (LHSV) of 0.5 to 3 $h^{-1}$.

According to another embodiment, catalytic hydroconversion of the heavy fraction may be carried out in two or more fixed-bed reactors connected in series, and the fixed-beds of the reactors may be loaded with three types of extrudate catalysts in different proportions. The catalysts of the fixed-beds of the reactors contain metals such as Pt, Pd, Ni, Mo and Co, among others, preferably Ni, Mo and Co, at concentrations of 2 to 15 weight % of each one in the fresh catalysts. In one embodiment, each of the catalyst beds has a higher metal concentration than the preceding catalyst bed. The catalysts of the fixed-beds may be supported on aluminum oxides, silica, titanium, and mixtures thereof, preferably on aluminum oxide (alumina) in its gamma phase, using particle sizes ranging from 1 to 3 mm diameter in cylindrical or extruded with different profiles, tablets or lobular shapes. The catalyst bed may be first preferably loaded with a hydrodemetallization catalyst in concentrations of 0.1 to 3 weight % of nickel and from 1 to 5 weight % of molybdenum, supported on gamma alumina. Next, the catalyst bed is loaded in an intermediate section, preferably with a hydrogenation-hydrocracking catalyst in concentrations of 0.5 to 5 weight % of nickel and 2 to 8 weight % of molybdenum, supported on gamma alumina. In one embodiment, the nickel and molybdenum concentration in the intermediate section is higher than the nickel and molybdenum concentration in the first catalyst bed.

The catalyst bed is loaded in its final section, preferably with a hydrogenating catalyst in concentrations of 1 to 5 weight % of nickel and from 5 to 12 weight % of molybdenum supported on gamma alumina. The nickel and molybdenum concentration in the final section is greater than the nickel and molybdenum concentration in the intermediate and first sections. The catalytic hydroconversion of the heavy fraction is carried out at a pressure of 40 to 130 $kg/cm^2$, a hydrogen to hydrocarbon ratio of from 2,000 to 7,000 $feet^3/bbl$, a temperature of 320 to 450° C. and a volumetric feed flow related to catalyst volume (LHSV) of 0.2 to 3 $h^{-1}$.

According to another embodiment, distillation of the hydrotreated products is carried out in an atmospheric distillation column, and thereafter in a vacuum distillation column, resulting in a product having similar properties to light and medium crude oils usually processed in a refinery scheme.

The volumetric yield of the fractions obtained from a heavy and/or extra-heavy crude oils is, for example, light naphtha up to 1%, intermediate naphtha up to 2%, heavy naphtha up to 3%, light distillate up to 4%, heavy distillate up to 7%, straight-run gas oil up to 5%, light vacuum gas oil up to 12%, and heavy vacuum gas oil up to 5%; and a decrease of the vacuum residue as much as 30%.

The process of the present invention removes impurities contained in heavy and/or extra-heavy crude oils, hydrodemetallization up to 90%, hydrodesulfurization up to 90%, hydrodenitrogenation up to 70%, carbon removal up to 60%, and asphaltenes removal up to 70%.

BRIEF DESCRIPTION OF THE DRAWINGS

FIG. 1 shows a process flow diagram of the present invention: hydroconversion-distillation of heavy and/or extra-heavy crude oils, more specifically referring to the catalytic hydroconversion of heavy and/or extra-heavy crude oils, and atmospheric and vacuum distillations of the hydrotreated product.

DETAILED DESCRIPTION OF THE INVENTION

The present invention relates to a process of the petroleum refining industry: hydroconversion-distillation of heavy and/or extra-heavy crude oils, more specifically to the catalytic hydroconversion of heavy and/or extra-heavy crude oils, and atmospheric and vacuum distillations of the hydrotreated product.

In this respect, it is important to point out that, by means of the process of the present invention such products that can be processed in conventional refining schemes designed to operate light and intermediates crudes are obtained.

The process of the present invention processes feedstocks with API gravity in the range of 3 to 30° API, and because of the nature of the feeds it comprises preheating of the same feed and feeding lines, in order to comply with optimal properties for transport (particularly viscosity) to the crude oil fractionation zone. Preheating of the feed can be carried out by heat exchange with hot streams of the same unit, while the heating pipes can be carried out using steam jackets. Under these conditions, it is necessary to guide the settlement process and equipment to optimize the energy balance when dealing with streams of high molecular weight and high viscosities.

FIG. 1 shows a process flow diagram of the present invention, which comprises four stages:

1) Desalting and separation of the feedstock;
2) Catalytic hydrotreating of the light fraction (optional);
3) Catalytic hydroconversion of the heavy fraction, and
4) Distillation of the hydrotreated products.

Step 1) Desalting and separation of the feedstock, that can be considered as a preparation of the feedstock (heavy and/or extra-heavy crude oils) to steps 2) and 3), consisting in desalting the heavy and/or extra-heavy crude oil, and adjusting the boiling range of light and heavy cuts, operating at atmospheric pressure and temperature of 280 to 420° C., prior to stages of hydrotreating and catalytic hydroconversion of said fractions, respectively. Step 2) catalytic hydrotreating of the light fraction is optionally carried out and would be performed at less severe operating conditions than those of step 3) catalytic hydroconversion of heavy fraction.

In this regard it is important to note that the separate treatment of these two fractions brings benefits on reduced investment and operating costs as the two fractions are hydrotreated by using different catalysts, operating conditions and type of reactors. Adjusting the boiling temperature of the two fractions is carried out by distillation. Typically, the light fraction comprises hydrocarbons with a boiling temperature below 360° C., while the heavy fraction comprises compounds with higher boiling temperature than this temperature until the final boiling point of the petroleum feedstock. These values are defined depending on the type and quality of petroleum feedstock and refining scheme.

For example, in an extra-heavy crude oil the light fraction can be very small if the fractionation is carried out at a very low final boiling temperature, so that the fractionation temperature is raised to increase the volume of this fraction. On the other hand, in a heavy crude oil the light fraction can be bigger and would require a decrease in the final temperature cut during fractionation. These decisions are made based on the type of crude to be processed, the operating conditions of the reactors, the size of the reactors (processing capacity) and on the desired properties of the final product.

The process of the present invention has the flexibility to operate under different qualities of the feedstock and required products.

In step 2) catalytic hydrotreating of the light fraction, due to its boiling temperature range (the initial boiling point of petroleum and cutting temperature in the first stage), the light fraction can mainly contain impurities of sulfur and nitrogen. The complexity of the molecules includes up to alkyl benzothiophenes, whose difficulty for removal occurs by steric hindrances. This fraction contains cuts of the type of naphthas, middle distillates and a small fraction of gasoils. The relative composition of each cut depends on the type of petroleum feed and the final boiling temperature of the light fraction.

The catalytic hydrotreatment of this light fraction can be carried out in a conventional reactor operating with catalysts of nickel-molybdenum (Ni—Mo) or cobalt-molybdenum (Co—Mo), in extruded form. The operating conditions of the reaction zone for the catalytic hydrotreatment are: operating pressure of 10 to 80 $kg/cm^2$, hydrogen to hydrocarbon ratio of 350 to 3,000 $ft^3/bbl$, temperature of 280 to 380° C. and liquid hourly space velocity (LHSV) of 0.5 to 3 $h^{-1}$; all other operating conditions of the catalytic hydrotreatment plant will be those provided in similar conventional units.

A variant of the process of the present invention is that it has the option of whether or not hydrotreat the light fraction mainly depending on the required quantity and quality of the products, because if the crude oil feedstock is so heavy, the volume of this fraction is very small. In this circumstance, it is desirable to directly feed this light fraction to atmospheric distillation column of step 4).

Step 3) catalytic hydroconversion of heavy fraction that has several purposes: on the one hand the reduction of content of impurities such as organometallic, sulfur and nitrogen compounds, and on the other hand reducing viscosity and increasing the API gravity of the feedstock. The catalytic hydroconversion is carried out in two or more fixed-bed reactors connected in series, the catalytic beds are loaded with three types of extrudate catalysts in different proportions. Each catalytic bed preferably has a catalyst concentration that is higher than the preceding catalyst bed such that the catalyst concentration increases from the feed end to the outlet end.

One of the properties of the catalytic bed is to have a hydrogenating function, which is achieved with catalysts containing metals that have the property to chemisorb hydrogen atoms such as: Pt, Pd, Ni, Mo and Co, among others, preferably Ni, Mo and Co, for their resistance to sulfur poisoning, in concentrations from 2 to 15 weight % each in the fresh catalyst.

Another important function of the catalyst bed is to retain the heavy metals containing in the heavy oil, mainly Ni, V, Fe, Cu and Pb; consequently a support is selected with high porosity such as oxides of aluminum, silica, titanium and mixtures thereof, these supports should also have adequate mechanical properties for reactor operation at high pressures and temperatures, and adequate size to avoid high pressure drops. The most suitable catalysts for this process typically use aluminum oxide support (alumina) in its gamma phase and particle sizes ranging from 1 to 3 mm diameter either cylindrical or extruded shapes with different profiles, tablets, or lobular.

An additional function of the catalyst bed used in the process of the present invention is to convert the sulfur and nitrogen compounds in the feedstock to hydrogen sulfide and ammonia, respectively; which is accomplished, to some extent, taking advantage of the catalyst property of chemisorb atoms of hydrogen, sulfur and nitrogen, whose function is properly performed by the active metals Ni and Mo in sulfide form by breaking the C—S—C and C—N—C bonds and saturate the sulfur and nitrogen to form hydrogen sulfide and ammonia respectively.

First in the catalyst bed a hydrodemetallization catalyst is loaded whose function is to partially hydrogenate the molecules of the heavy compounds, for which the catalyst has a relatively low hydrogenating function capable to hydrocrack; the catalyst permits reactions to favor removal of heavy metals. Such a catalyst contains low amounts of nickel and molybdenum supported on gamma alumina in concentrations of 0.1 to 3 weight % of nickel and 1 to 5 weight % of molybdenum.

The intermediate portion of the catalyst bed has hydrogenation-hydrocracking balanced functions, hydrogenation function allows more reactions for promoting the removal of sulfur and nitrogen as well as the saturation of aromatics present in the separate chains of large molecules by the effect of the hydrocracking function, to meet these objectives, the catalyst of the intermediate zone of the catalytic bed is formulated with 0.5 to 5 weight % of nickel and from 2 to 8% by weight of molybdenum. The catalyst concentration in the intermediate zone is preferably higher than in the first catalyst bed.

The final part of the catalyst bed is loaded with a catalyst, mainly for the hydrogenating function to favor the removal of sulfur and saturation of the hydrogen deficient species; the concentrations of active metal in this catalyst are 1 to 5% by weight of nickel and 5 to 12 weight % of molybdenum. The catalyst concentration in the final bed is preferably higher than in the intermediate zone.

The three types of catalysts are loaded into the reactor using the procedures applicable to the industrial scale, in addition to the catalyst bed relaxer pressure drop materials that may or may not have catalytic activity for hydrogenation, hydrocracking, or both must be loaded. Different profiles of shape can be used in the active catalysts such as cylindrical extruded, lobe or spheres in sizes ranging from 1 to 3 millimeters in diameter. Relaxants materials may also have different shape, including: spheres, tablets, raschig rings and similar.

In order to adequately fulfill the processing of crude oil, the process of the present invention employs at least two fixed-bed reactors, with the arrangement of several reactors having the following main advantages:

- adequately exploit the function of each catalyst throughout the reactor;
- reduce the problems of pressure drop across the catalyst beds, and
- add additional amounts of hydrogen between the different reactors and thereby maintain a proper hydrogen/hydrocarbon ratio ($H_2$/HC) in each reactor, thus decreasing the effects of high temperature in the catalytic bed derived from the evolution of heat.

As a result of the exothermic nature of the reactions, it is necessary to add hydrogen streams along the catalyst bed and the inlet of the second reactor, the effect of addition of the hydrogen stream is:

- replacing the hydrogen consumed in the first reactor in order to maintain a suitable ratio of hydrogen/hydrocarbon in the second reactor;
- controlling the generation of heat and control the system temperature in the needed values to ensure the proper operation of the reactors, and
- limit the formation of carbon reactions and its deposit on the surface of the catalyst.

The operating conditions of the reaction zone are: pressure of 40 to 130 kg/cm$^2$, temperature of 320 to 450° C., hydrogen/hydrocarbon ratio from 2,000 to 7,000 ft$^3$/bbl, and space velocity (LHSV) of 0.2 to 3 h$^{-1}$. Depending on the quality of the feedstock and the desired results in products of the process, it is possible to combine these different values of operating variables.

Step 4) Distillation of the hydrotreated products, that comprises the feeding of the light and heavy fractions obtained in steps 2) and 3) to an atmospheric distillation column.

The light fraction fed to the atmospheric column might be hydrotreated or not, depending on their levels of contaminants such as sulfur or nitrogen and especially its volumetric content in the petroleum feed; the point of feeding of the light fraction obtained in step 2) to the atmospheric distillation column depends on the particular design of this column and is usually fed into the intermediate portion of the column, depending on its composition and temperature profile of the column.

Moreover, the heavy fraction obtained in step 3) is always added to the bottom of the atmospheric distillation column.

In this primary distillation naphtha and middle distillates cuts are obtained, and the atmospheric residue as well; the latter is fed to the vacuum distillation column where the light and heavy vacuum gasoils cuts and vacuum residue are obtained. All fractionated cuts in both the primary and vacuum distillation columns, are sent to the various downstream refining processes.

Among the main technical contributions of the process of the present invention, compared with conventional refining processes are the following:

- increases the yield of distillate fractions and decreases the concentration of pollutants such as: sulfur, nitrogen, metals, etc., favoring the downstream plants operating at less severe conditions with the consequent increase in the lifetime of the catalysts and the reduced operating costs by reducing the consumption of utilities.
- allows existing and conventional refineries to process larger amounts of heavy and extra-heavy crude oils. Existing and conventional refineries means those that were designed for processing light and intermediates crude oils and their mixtures, in particular those having API gravity higher than 22 units.
- The light and heavy fractions obtained can be fed to the atmospheric distillation column in existing refineries, because their properties are similar to those of light and intermediates crude oils which are usually processed. For example, it is possible to increase the API gravity of the heavy fraction due to the addition of hydrogen to the poly aromatic molecules of the crude and thus not disturbing the operation of the atmospheric column. It also increases the yield of distillates of high commercial value.

EXAMPLES

To better illustrate the process of the present invention, below are some examples, which do not limit the scope of what is claimed herein.

Example 1

A heavy crude oil with 15.93° API and complimentary properties presented in Table 1, was subjected to step 1) Desalting and separation of the feedstock, of the process of the present invention, obtaining a light fraction and a heavy fraction with 42.61 and 6.78° API, respectively, among other properties shown in Table 1.

TABLE 1

Properties of heavy crude oil under step 1) Desalting and separation of the feedstock, of the process of the present invention, and light and heavy obtained fractions, (Example 1).

| | Heavy | Fraction | |
|---|---|---|---|
| Properties | Crude oil | Light | Heavy |
| Yield, volume %. | 100 | 29.1 | 70.9 |
| API Gravity | 15.93 | 42.61 | 6.78 |
| Sulfur, weight % | 4.602 | 1.748 | 5.52 |
| Conradson carbon, weight % | 15.87 | — | 19.80 |
| n-heptane-lnsolubles, weight % | 15.66 | — | 20.57 |
| Nickel, wppm | 69.20 | — | 104 |
| Vanadium, wppm | 361.0 | — | 501 |
| Distillation, volume %. | D-2892 | D-86 | D-1160 |
| IBP/10 | 28/173 | 60/117 | 369/397 |
| 20/30 | 266/353 | 145/171 | 440/491 |
| 40/50 | 432/504 | 197/226 | |
| 60/70 | | 247/270 | |
| 80/90 | | 286/305 | |
| FBP | 538 | 321 | 538 |
| Recovered at 538° C., volume %. | 54.59 | | 38.01 |

IBP: Initial Boiling Point
TFE: Final Boiling Point

From Table 1, it is important to emphasize the zero contents of n-heptane-insolubles (asphaltenes), nickel and vanadium in the light fraction, which ensures that the catalysts used in step 1) desalting and separation of the feedstock, do not experience significant deactivation during the time-on-stream. Such impurities are concentrated in the heavy fraction which is fed to step 2) catalytic hydrotreating of the light fraction, wherein the catalysts used here suitable properties for accumulating heavy metals, and breaking the complex molecules of asphaltenes to produce lighter distillates.

The light fraction obtained in the step 1 of Example 1 was subjected to a second step 2) Catalytic hydrotreating of the light fraction, of the process of the present invention, at the operating conditions indicated in Table 2.

TABLE 2

Operating conditions of step 2) Catalytic hydrotreating of the light fraction, of the present invention, obtained in step 1), (Example 1).

| Variable | Condition |
|---|---|
| Pressure, kg/cm$^2$ | 54 |
| Temperature, ° C. | 340 |

TABLE 2-continued

| Operating conditions of step 2) Catalytic hydrotreating of the light fraction, of the present invention, obtained in step 1), (Example 1). | |
|---|---|
| Variable | Condition |
| Space velocity (LHSV), $h^{-1}$ | 2.5 |
| $H_2$/HC ratio, $feet^3$/bbl | 2,000 |

The properties of the product obtained in step 2) of Example 1, are shown in Table 3.

TABLE 3

| Properties of the hydrotreated light fraction, obtained in step 2) Catalytic hydrotreating of the light fraction, of the process of the present invention, (Example 1). | |
|---|---|
| Property | Value |
| Yield, volume %. | 100.32 |
| Specific gravity 60/60 ° F. | 0.8030 |
| API Gravity | 44.71 |
| Sulfur, weight % | 0.048 |
| Distillation, volume %. | |
| IBP/10 | 76/127 |
| 20/30 | 151/172 |
| 40/50 | 197/220 |
| 60/70 | 240/259 |
| 80/80 | 279/300 |
| FBP | 321 |

IBP: Initial boiling point
FBP: Final Boiling Point

From Table 3 it is important to note the considerable reduction of sulfur content in the product, from 1,748 weight % of sulfur in the light fraction (Table 1) to 0.048 weight % of sulfur in the product (Table 3).

The heavy fraction obtained in step 1) of Example 3 was subjected to Step 3) catalytic hydroconversion of heavy fraction, using two fixed-bed reactors connected in series at the operating conditions shown in Table 4.

TABLE 4

| Operating conditions of step 3) Catalytic hydroconversion of the heavy fraction, of the present invention, obtained in step 1), (Example 1). | | |
|---|---|---|
| Variable | Reactor 1 | Reactor 2 |
| Pressure, $kg/cm^2$ | 100 | 100 |
| Temperature, ° C. | 386 | 386 |
| Space velocity (LHSV), $h^{-1}$ | 0.25 | 0.25 |
| $H_2$/HC ratio, $feet^3$/bbl | 5,000 | 5,000 |

Product properties obtained in the step 3) of Example 1, are shown in Table 5.

TABLE 5

| Properties of the hydroconverted heavy fraction, obtained in step 3) catalytic hydroconversion of the heavy fraction, of the process of the present invention, (Example 1). | |
|---|---|
| Property | Hydroconverted heavy fraction |
| Yield, volume % | 104.57 |
| API Gravity | 18.17 |
| Sulfur, weight % | 0.8583 |
| Conradson carbon, weight % | 9.76 |
| n-heptane-Insolubles, weight % | 8.64 |
| Nickel, ppm | 42.40 |
| Vanadium, ppm | 132.50 |

TABLE 5-continued

| Properties of the hydroconverted heavy fraction, obtained in step 3) catalytic hydroconversion of the heavy fraction, of the process of the present invention, (Example 1). | |
|---|---|
| Property | Hydroconverted heavy fraction |
| Distillation, volume % | |
| IBP/10 | 225/328 |
| 20/30 | 375/407 |
| 40/50 | 446/491 |
| 60/70 | 530/ |
| 80/90 | |
| FBP | 538 |
| Recovered at 538° C., volume % | 62.85 |

IBP: Initial boiling point
FBP: Final Boiling Point

From Table 5, it is important to underline the considerable increase in API gravity: from 6.78 in the heavy fraction (Table 1) to 18.17 in the product (Table 5), ensuring higher production of valuable distillates.

The hydrotreated light and hydroconverted heavy fractions obtained in stages 2) and 3) of Example 1 were subjected to step 4) Distillation of the hydrotreated products, of the present invention. The yields and properties of the distillates obtained from this fractionation are shown in Table 6.

TABLE 6

| Properties and yields of the distillates obtained in step 4) Distillation of the hydrotreated products, of the process of the present invention, (Example 1). | | | | | |
|---|---|---|---|---|---|
| Fraction | Distillation range, ° C. | Yield, volume % | Specific gravity | Gravity API | Sulfur, weight % |
| Light naphtha | IBP-71 | 1.58 | 0.6608 | 82.63 | 0.0033 |
| Medium naphtha | 71-177 | 10.02 | 0.7492 | 57.37 | 0.0077 |
| Heavy naphtha | 177-204 | 4.56 | 0.7953 | 46.42 | 0.0084 |
| Light distillate | 204-274 | 11.66 | 0.8281 | 39.37 | 0.0093 |
| Heavy distillate | 274-316 | 8.78 | 0.8559 | 33.82 | 0.0169 |
| Light gasoil | 316-343 | 5.40 | 0.8734 | 30.51 | 0.1172 |
| Light vacuum gasoil | 343-454 | 22.16 | 0.9012 | 25.51 | 0.2120 |
| Heavy vacuum gasoil | 454-538 | 11.34 | 0.9247 | 21.52 | 0.2807 |
| Vacuum residue | 538° C.+ | 24.5 | 1.0264 | 6.36 | 1.8973 |

IBP: Initial boiling point

From Table 6 it is important to note the significant reduction in the recovered fraction at 538° C., volume % or vacuum residue, from 54.59 volume % in the heavy oil feed (Table 1) to 24.5 volume % in the product (Table 6). This reduction increases the production of other distillates.

Example 2

A heavy crude oil with 21.24° API and other properties presented in Table 7, was subjected to step 1) desalting and separation of the feedstock of the present invention, obtaining light and heavy fractions with 42.98 and 6.97° API respectively, among other properties presented in Table 7.

TABLE 7

Properties of heavy oil, under the step 1) Desalting and separation of the feedstock, of the process of the present invention, and light and heavy obtained fractions, (Example 1).

| Property | Crude | Fraction Light | Fraction Heavy |
|---|---|---|---|
| Yield, volume %. | 100 | 43.86 | 56.14 |
| API gravity | 21.24 | 42.98 | 6.97 |
| Sulfur, weight % | 3.501 | 1.1921 | 4.78 |
| Conradson carbon, weight % | 10.48 | — | 17.61 |
| n-heptane-Insolubles, weight % | 9.51 | — | 17.72 |
| Nickel, ppm | 52.64 | — | 87.6 |
| Vanadium, ppm | 247.7 | — | 411.5 |
| Distillation, volume %. | D-2892 | D-86 | D-1160 |
| IBP/10 | 13/130 | 48/125 | 366/447 |
| 20/30 | 199/269 | 150/175 | 487/533 |
| 40/50 | 344/423 | 200/225 | |
| 60/70 | 509/ | 250/276 | |
| 80/90 | | 300/331 | |
| FBP | 538 | 373 | 538 |
| Recovered at 538° C., volume %. | 63.2 | | 31.3 |

IBP: Initial boiling point
FBP: Final Boiling Point

The light fraction obtained in the step 1) of Example 2, was subjected to a second step 2) Catalytic hydrotreating of the light fraction, of the process of the present invention, at operating conditions indicated in Table 8.

TABLE 8

Operating conditions of step 2) catalytic hydrotreating of the light fraction, of the process of the present invention, obtained in step 1), (Example 2).

| Variable | Condition |
|---|---|
| Pressure, kg/cm$^2$ | 54 |
| Temperature, ° C. | 340 |
| Space velocity (LHSV), h$^{-1}$ | 2.5 |
| $H_2$/HC ratio, feet$^3$/bbl | 2,000 |

Product properties obtained in step 2) of Example 2 are shown in Table 9.

TABLE 9

Properties of the hydroconverted light fraction, obtained in step 2) catalytic hydrotreatment of the heavy fraction, of the process of the present invention, (Example 2).

| Property | Value |
|---|---|
| Yield, volume %. | 100.26 |
| Specific gravity 60/60 ° F. | 0.8053 |
| API gravity | 44.21 |
| Total sulfur, weight % | 0.044 |
| Distillation, volume %. | |
| IBP/10 | 46/123 |
| 20/30 | 148/173 |
| 40/50 | 198/223 |
| 60/70 | 248/274 |
| 80/90 | 298/329 |
| FBP | 372 |

IBP: Initial boiling point
FBP: Final Boiling Point

The heavy fraction obtained in step 1) of Example 2 was subjected to Step 3) Catalytic hydroconversion of the heavy fraction, of the process of the present invention, using two fixed-bed reactors connected in series at the operating conditions shown in Table 10.

TABLE 10

Operating conditions of step 3) catalytic hydroconversion of the heavy fraction, of the process of present invention, obtained in step 1), (Example 2).

| Variable | Reactor 1 | Reactor 2 |
|---|---|---|
| Pressure, kg/cm$^2$ | 100 | 100 |
| Temperature, ° C. | 400 | 400 |
| Space velocity (LHSV), h$^{-1}$ | 1.0 | 0.5 |
| $H_2$/HC ratio, feet$^3$/bbl | 5,000 | 5,000 |

Properties of the product obtained in step 3) of Example 2 are shown in Table 11.

TABLE 11

Properties of the hydroconverted heavy fraction, obtained in step 3) catalytic hydroconversion of the heavy fraction, in the process of the present invention (Example 2).

| Property | Hydroconverted heavy fraction |
|---|---|
| Yield, volume %. | 103.3 |
| API gravity | 19.06 |
| Sulfur, weight % | 0.982 |
| Conradson carbon, weight % | 8.63 |
| n-heptane-Insolubles, weight % | 8.59 |
| Nickel, ppm | 45 |
| Vanadium, ppm | 156.5 |
| Distillation, volume %. | |
| IBP/10 | 62/264 |
| 20/30 | 340/378 |
| 40/50 | 403/439 |
| 60/70 | 488/530 |
| 80/90 | |
| FBP | 538 |
| Recovered at 538° C., volume %. | 72.6 |

IBP: Initial boiling point
FBP: Final Boiling Point

The hydrotreated light and hydroconverted heavy fractions obtained in stages 2) and 3) of Example 2, were subjected to step 4) distillation of the hydrotreated products, of the present invention. The yields and properties of the distillates obtained from this fractionation are shown in Table 12.

TABLE 12

Properties and yields of the distillates obtained in step 4) distillation of the hydrotreated products, of the process of the present invention, (Example 2).

| Fraction | Distillation range, ° C. | Yield, volume % | Specific gravity | API Gravity | Total sulfur, weight % |
|---|---|---|---|---|---|
| Light naphtha | IBP-71 | 2.4 | 0.6849 | 75.10 | 0.0027 |
| Medium naphtha | 71-177 | 14.6 | 0.7644 | 53.61 | 0.0058 |
| Heavy naphtha | 177-204 | 4.5 | 0.8038 | 44.54 | 0.0086 |
| Light distillate | 204-274 | 14.9 | 0.8340 | 38.16 | 0.0099 |
| Heavy distillate | 274-316 | 8.0 | 0.8644 | 32.20 | 0.0164 |
| Light gasoil | 316-343 | 5.3 | 0.8824 | 28.86 | 0.1243 |
| Light vacuum gasoil | 343-454 | 23.8 | 0.9083 | 24.29 | 0.2332 |
| Heavy vacuum gasoil | 454-538 | 11.3 | 0.9438 | 18.43 | 0.2744 |
| Vacuum residue | 538° C.+ | 15.20 | 1.0229 | 6.84 | 1.8795 |

IBP: Initial boiling point

Example 3

A heavy crude with 15.93° API and the properties presented in Table 13, was subjected to step 1) desalting and separation of the feedstock, of the process of the present invention, obtaining a light and heavy fractions were with 42.61 and 6.78° API, respectively, among other properties presented in Table 13.

TABLE 13

Properties of heavy crude oil under step 1) Desalting and separation of the feedstock, of the process of the present invention, and light and heavy obtained fractions, (Example 3).

| Property | Crude | Fraction Light | Fraction Heavy |
|---|---|---|---|
| Yield, volume %. | 100 | 29.1 | 70.9 |
| API gravity | 15.93 | 42.61 | 6.78 |
| Sulfur, weight % | 4.602 | 1.748 | 5.52 |
| Conradson carbon, weight % | 15.87 | — | 19.08 |
| n-heptane-Insolubles, weight % | 15.66 | — | 20.57 |
| Nickel, ppm | 69.2 | — | 104 |
| Vanadium, ppm | 361.0 | — | 501 |
| Distillation, volume %. | D-2892 | D-86 | D-1160 |
| IBP/10 | 28/173 | 60/117 | 369/397 |
| 20/30 | 266/353 | 145/171 | 440/491 |
| 40/50 | 432/504 | 197/226 | |
| 60/70 | | 247/270 | |
| 80/90 | | 286/305 | |
| FBP | 538 | 321 | 538 |
| Recovered at 538° C., volume %. | 54.59 | | 38.01 |

IBP: Initial boiling point
FBP: Final Boiling Point

The light fraction obtained in the step 1) of Example 3 was not subjected to a second step 2) catalytic hydrotreating of the light fraction, of the process of the present invention.

The heavy fraction obtained in step 1) of Example 3 was subjected to Step 3) catalytic hydroconversion of heavy fraction, of the process of the present invention, using two fixed bed reactors connected in series at the operating conditions shown in Table 14.

TABLE 14

Operating conditions of step 3) catalytic hydroconversion of the heavy fraction of the process of the present invention obtained in step 1), (Example 3).

| Variable | Reactor 1 | Reactor 2 |
|---|---|---|
| Pressure, kg/cm$^2$ | 100 | 100 |
| Temperature, ° C. | 386 | 386 |
| Space velocity (LHSV), h$^{-1}$ | 0.25 | 0.25 |
| $H_2$/HC ratio, feet$^3$/bbl | 5,000 | 5,000 |

The properties of the product obtained in step 3) of Example 3 are shown in Table 15.

TABLE 15

Properties of the hydroconverted heavy fraction, obtained in step 3) catalytic hydroconversion of heavy fraction, of the process of the present invention (Example 3).

| Property | Hydroconverted heavy fraction |
|---|---|
| Yield, volume %. | 104.57 |
| API gravity | 18.17 |
| Sulfur, weight % | 0.8583 |
| Conradson carbon, weight % | 9.76 |
| n-heptane-Insolubles, weight % | 8.64 |
| Nickel, ppm | 42.40 |
| Vanadium, ppm | 132.50 |
| Distillation, volume %. | |
| IBP/10 | 225/328 |

TABLE 15-continued

Properties of the hydroconverted heavy fraction, obtained in step 3) catalytic hydroconversion of heavy fraction, of the process of the present invention (Example 3).

| Property | Hydroconverted heavy fraction |
|---|---|
| 20/30 | 375/407 |
| 40/50 | 446/491 |
| 60/70 | 530/ |
| 80/90 | |
| FBP | 538 |
| Recovered at 538° C., volume %. | 62.85 |

IBP: Initial boiling point
FBP: Final Boiling Point

The light fraction obtained from step 1) and the hydroconverted heavy fraction obtained in step 3) of Example 3 were subjected to step 4) distillation of the hydrotreated products, of the present invention. The yields and properties of the distillates obtained from this fractionation are shown in Table 12.

TABLE 16

Properties and yields of the distillates obtained in step 4) distillation of the hydrotreated products, of the process of the present invention, (Example 2).

| Fraction | Distillation range, ° C. | Yield, volume % | Specific gravity | Gravity API | Sulfur total, weight % |
|---|---|---|---|---|---|
| Light naphtha | IBP-71 | 1.7 | 0.6657 | 81.06 | 0.0290 |
| Medium naphtha | 71-177 | 10.75 | 0.7528 | 56.46 | 0.2338 |
| Heavy naphtha | 177-204 | 3.11 | 0.7990 | 45.6 | 0.6729 |
| Light distillate | 204-274 | 13.04 | 0.8330 | 38.37 | 0.8978 |
| Heavy distillate | 274-316 | 11.40 | 0.8666 | 31.78 | 0.9635 |
| Light gasoil | 316-343 | 7.35 | 0.8798 | 29.33 | 1.0316 |
| Light vacuum gasoil | 343-454 | 19.45 | 0.8933 | 26.9 | 0.5509 |
| Heavy vacuum gasoil | 454-538 | 7.38 | 0.9296 | 20.72 | 0.5619 |
| Vacuum residue | 538° C.+ | 25.82 | 1.0253 | 6.51 | 2.0212 |

IBP: Initial boiling point

What is claimed is:

1. A process for the hydroconversion-distillation of heavy and extra heavy crude oils to obtain an upgraded crude oil, which comprises desalting a feedstock comprising heavy and/or extra heavy crude oil at atmospheric pressure and at a temperature of 280° C. to 420° C. to obtain a desalted feedstock, passing said desalted feedstock directly to a distillation zone where said desalted feedstock is subjected to a temperature in the range of from 280 to 420° C. at atmospheric pressure to obtain a light fraction and a heavy fraction, said light fraction containing light gas oil, naphtha and middle distillates having a boiling point of below 360° C., said heavy fraction containing asphaltenes and having a boiling point greater than 360° C.;

subjecting said light fraction to catalytic hydrotreatment in the presence of hydrogen to obtain a hydrotreated fraction and to remove sulfur and nitrogen compounds;

subjecting said heavy fraction to catalytic hydroconversion in the presence of hydrogen to obtain a hydroconverted fraction having a reduced the viscosity and increased the API gravity; and feeding said hydrotreated fraction and said hydroconverted fraction to an atmospheric distillation apparatus to obtain a distilled light and medium fraction containing naphtha and middle distillates for processing in a process for light and medium crude oils and an atmospheric residue, separating said atmospheric residue and feeding to a vacuum distillation column and recovering a light as oil fraction, a heavy gas oil fraction, and a vacuum residue.

2. The process of claim 1, wherein said feedstock comprises crude oil having 3 to 30 API gravity units.

3. The process of claim 2, wherein said feedstock comprises crude oil having 3 to 10 API gravity units.

4. The process of claim 1, wherein said catalytic hydrotreatment of said light fraction is carried out with catalysts of nickel-molybdenum (Ni—Mo) or cobalt-molybdenum (Co—Mo), in extruded or spherical shape.

5. The process of claim 1, wherein said catalytic hydrotreatment of said light fraction is carried out at a pressure of 10 to 80 kg/cm$^2$, hydrogen to hydrocarbon ratio of 350 to 3,000 ft$^3$/bbl, temperature of 280 to 380° C. and the volumetric feed flow related to catalyst volume (LHSV) of 0.5 to 3 h$^{-1}$.

6. The process of claim 1, wherein said heavy fraction has an initial boiling point above 360° C. and said catalytic hydroconversion of said heavy fraction is carried out in two or more fixed-bed reactors connected in series.

7. The process of claim 6, wherein said fixed-bed reactor comprise three sequential zones having an increased catalyst concentration than a preceding fixed bed.

8. The process of claim 6, wherein the catalysts of the fixed-bed reactors comprise metals selected from the group consisting of Pt, Pd, Ni, Mo and Co, at concentrations of 2 to 15 weight % of each one in the fresh catalysts.

9. The process of claim 8, wherein said metals are selected from the group consisting of Ni, Mo and Co.

10. The process of claim 8, wherein said catalysts are supported on aluminum oxides, silica, titanium, and mixtures thereof, and where said reactor has a first bed having a catalyst concentration of 0.1-3 wt %, Ni and 1-5 wt % Mo, a second bed having a catalyst concentration greater than said first bed and having catalyst concentration of 0.5-5 wt % Ni and 2-8 wt % Mo, and a third bed having a catalyst concentration greater than said second bed and having a catalyst concentration of 1-5 wt % Ni and 5-12 wt % Mo.

11. The process of claim 10, wherein said support is aluminum oxide in its gamma phase and particle sizes ranging from 1 to 3 mm diameter in cylindrical or extruded with different profiles, tablets or lobular shapes.

12. The process of claim 7, wherein a first zone of said three zones is loaded with a hydrodemetallization catalyst in concentrations of 0.1 to 3 weight % of nickel and from 1 to 5 weight % of molybdenum, supported on gamma alumina.

13. The process of claim 12, wherein an intermediate zone is loaded with a hydrogenation-hydrocracking catalyst in concentrations of 0.5 to 5 weight % of nickel and 2 to 8 weight % of molybdenum, supported on gamma alumina and where said catalyst concentration of said intermediate zone is greater than said first zone.

14. The process of claim 13, wherein a third zone is loaded with a hydrogenating catalyst in concentrations of 1 to 5 weight % of nickel and from 5 to 12 weight % of molybdenum supported on gamma alumina, and where said catalyst concentration of said third zone is greater than said intermediate zone.

15. The process of claim 6, wherein said catalytic hydroconversion of said heavy fraction is carried out at a pressure of 40 to 130 kg/cm$^2$, a hydrogen to hydrocarbon ratio of from 2,000 to 7,000 feet$^3$/bbl, a temperature of 320 to 450° C. and the volumetric feed flow related to catalyst volume (LHSV) of 0.2 to 3 h$^{-1}$.

16. The process of claim 1, wherein said vacuum residue has an API gravity higher than 22 units.

17. The process of claim 1, wherein said process increases the volumetric yield of the fractions obtained from a heavy and/or extra-heavy crude oils: light naphtha up to 1%, intermediate naphtha up to 2%, heavy naphtha up to 3%, light distillate up to 4%, heavy distillate up to 7%, straight-run gas oil up to 5%, light vacuum gas oil up to 12%, and heavy vacuum gas oil up to 5%; in addition to a decrease of the vacuum residue as high as 30%.

18. The process of claim 1, wherein said process removes impurities contained in heavy and/or extra-heavy crude oils: hydrodemetallization up to 90%, hydrodesulfurization up to 90%, hydrodenitrogenation up to 70%, carbon removal up to 60%, and asphaltenes removal up to 70%.

19. A process for the hydroconversion-distillation of extra heavy crude oils to obtain an upgraded crude oil, which comprises desalting a feedstock comprising an extra heavy crude oil at atmospheric pressure and at a temperature of 280° C. to 420° C. using fresh water to obtain a desalted extra heavy crude oil feedstock, passing the desalted extra heavy crude oil feedstock directly to a distillation column to separate the desalted extra heavy crude oil feedstock into a light fraction and a heavy fraction, said light fraction containing light gas oil having a boiling point below 360° C. and said heavy fraction having an initial boiling point above 360° C.;

subjecting said light fraction to catalytic hydrotreatment in the presence of hydrogen to reduce the concentration of sulfur and nitrogen compounds and to obtain a hydrotreated light fraction;

subjecting said heavy fraction to catalytic hydroconversion in the presence of hydrogen in a fixed-bed reactor having a first bed, a second bed, and a third bed connected in series with hydrogen added to an inlet and along the catalyst beds of the second reactor, each of said fixed-bed reactors contains a Ni—Mo catalyst supported on gamma alumina and where said first bed comprises a catalyst having 0.1-3 wt % No and 1-5 wt % Mo, a second bed comprising a catalyst having 0.5 to 5 wt % Ni and 2-8 wt % Mo and has a catalyst concentration greater than said first bed, and a third bed comprising a catalyst having 1-5 wt % Ni and 5-12 wt % Mo and a catalyst concentration greater than said second bed, said catalytic hydroconversion being carried out to remove sulfur and nitrogen compounds from said heavy fraction and increase the API gravity; and feeding said hydrotreated light fraction and said catalytic hydroconversion heavy fraction to an atmospheric distillation column to obtain a first fraction containing a light and medium crude oil fraction and an atmospheric residue fraction, subjecting said atmospheric residue fraction to vacuum distillation to obtain a vacuum light gas oil, a vacuum heavy gas oil, and a vacuum residue.

20. A process for the hydroconversion-distillation of heavy and extra heavy crude oils, consisting essentially of, in order:

a. desalting a feedstock comprising heavy and/or extra heavy crude oil using fresh water at atmospheric pressure and at a temperature of 280° C. to 420° C. to obtain a desalted feedstock, b. passing said desalted feedstock to an atmospheric distillation zone where said desalted feedstock is subjected to a temperature in the range of from 280 to 420° C. at atmospheric pressure to obtain a light fraction having a boiling point below 360° C. and a heavy fraction having a boiling point above 360° C., said light fraction containing light gas oil; and c. subjecting said light fraction to catalytic hydrotreatment in the presence of hydrogen to obtain a hydrotreated light fraction and subjecting said heavy fraction to catalytic hydroconversion in the presence of hydrogen to obtain a hydroconversion heavy fraction; and feeding said hydrotreated light fraction and said hydroconvertion heavy fraction to an atmospheric distillation column to obtain first fraction containing light and medium distilled crude oil fractions for processing in refining schemes designed to process light and medium crude oils and an atmospheric residue, and feeding said atmospheric residue to a vacuum distillation column and recovering a vacuum light gas oil, a vacuum heavy oil and a vacuum residue.

* * * * *